United States Patent [19]

Lacasse

[11] 4,177,738

[45] Dec. 11, 1979

[54] FURNITURE WITH OPENING FLAP AND SUPPORT THEREFOR

[76] Inventor: Rejean Lacasse, 167 St. Francois St., Saint-Pie de Bagot, Canada, J0H 1W0

[21] Appl. No.: 871,206

[22] Filed: Jan. 23, 1978

[51] Int. Cl.[2] ..... A47B 1/04; A47B 81/00

[52] U.S. Cl. ..... 108/78; 312/22; 312/23; 112/217.1

[58] Field of Search ..... 312/22, 23; 112/217.1; 16/179; 403/372; 108/69, 78, 90

[56] References Cited

U.S. PATENT DOCUMENTS

| | | | |
|---|---|---|---|
| 845,471 | 2/1907 | Mitchell | 112/217.1 |
| 1,742,932 | 1/1930 | Perry et al. | 108/69 |
| 1,798,786 | 3/1931 | Chason | 108/78 |
| 1,994,742 | 3/1935 | Altorfer | 312/22 |
| 2,420,698 | 5/1947 | Best | 108/78 |
| 2,458,627 | 1/1949 | North | 108/78 |
| 2,714,743 | 8/1955 | Lochner | 108/78 |
| 2,731,317 | 1/1956 | Duncan | 108/78 |
| 2,844,125 | 7/1958 | Wehn | 403/372 |
| 3,806,217 | 4/1974 | Current | 312/23 |
| 3,990,744 | 11/1976 | Rodaway | 403/372 |

*Primary Examiner*—Victor N. Sakran

[57] ABSTRACT

A piece of furniture having at least one flap pivotable to a flat open position, as the flap of a sewing machine cabinet, and including a support device for the flap in such operative flat position. This support device advantageously strengthens the portion of the piece of furniture to which the flap is pivotally connected, is adapted to be readily added to an existing piece of furniture, and retracts to an unconspicuous inoperative position inside the body of the piece of furniture. This piece of furniture comprises a flap pivoted to the top thereof, a bracket fixed against the lower face of the top, a body of sliding resistant material secured to the bracket, and a supporting arm slidable endwise through this body of sliding resistant material and outwardly extendable in operative supporting position against the lower face of the flap outwardly extending in flat open position.

1 Claim, 5 Drawing Figures

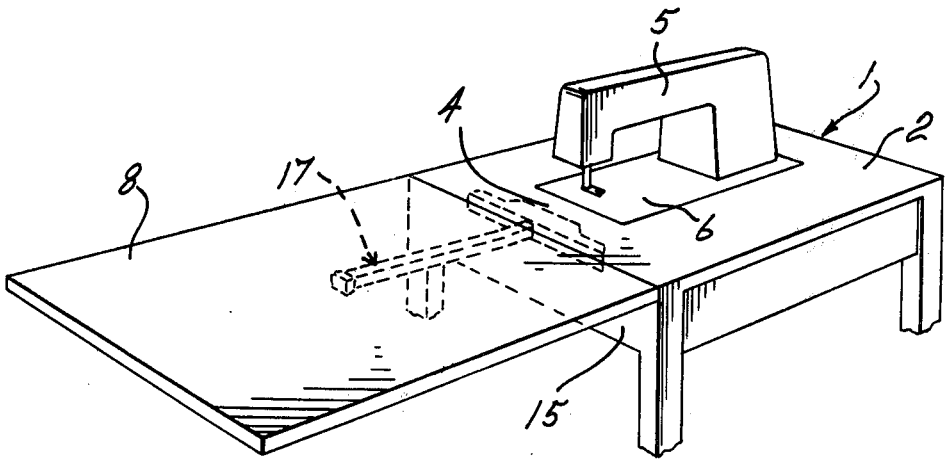

FURNITURE WITH OPENING FLAP AND SUPPORT THEREFOR

This invention relates to furniture of the type including a flap which opens to a flat position and a retractable support to operatively hold the flap in open position.

There are many different pieces of furniture which are made with one or two flaps that pivot to an open flat position. In particular, there is the conventional sewing machine cabinet which has a relatively large flap which opens to form a working surface to support the material being sewn. Various support devices have been proposed so far to hold such flap in open position.

The previously proposed support devices are not found satisfactory on account for instance of the looseness which develops and the resulting strain on the hinge between the flap and the furniture body and on account of conspicuous outward projection of such device relative to the furniture body. In the particular case of the sewing machine cabinet, the top of the cabinet has a central aperture forming a recess for the sewing machine and bordered on one side by a relatively narrow edge portion of the top. The flap is conventionally pivoted to such narrow edge portion which is subjected to excessive strains due to the pivotal connection of the flap there to.

It is a general object of the present invention to provide a piece of furniture of the above type with a flap support adapted to avoid the above-mentioned disadvantages.

It is an object of the present invention to provide a piece of furniture of the above type with a flap support which is of reliable and easy operation and reinforces the above-mentioned narrow edge portion of a sewing machine cabinet.

It is a further object of the present invention to provide a piece of furniture of the above type with a flap support which is of reliable and easy operation and reinforces the above-mentioned narrow edge portion of a sewing machine cabinet.

It is a further object of the present invention to provide a piece of furniture of the above type with a flap support which is of simple construction and is readily added to the existing piece of furniture.

It is still another object of the present invention to provide a piece of furniture of the above type which retracts to an unconspicuous inoperative position inside the body of the piece of furniture.

The above and other objects and advantages of the present invention will be better understood with reference to the following detailed description of a preferred embodiment thereof which is illustrated, by way of example, in the accompanying drawings; in which.

Figure 1:
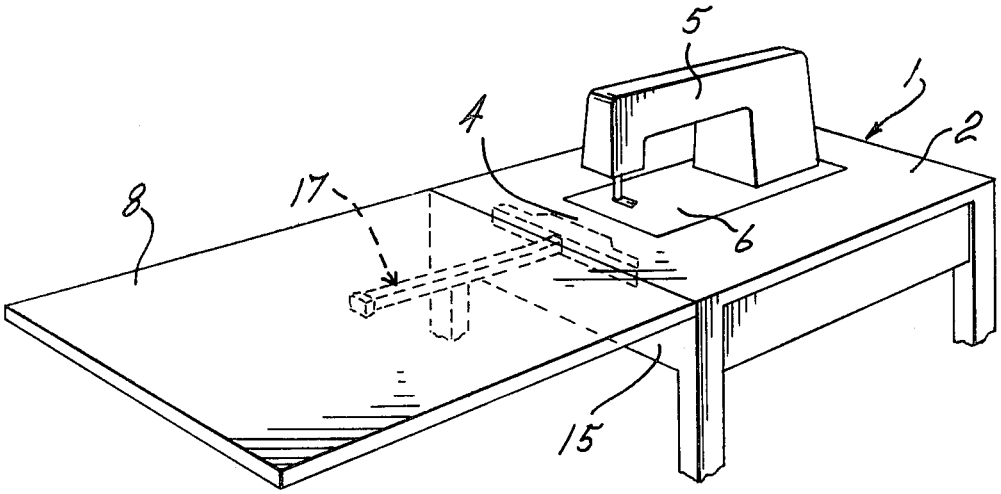
FIG. 1 is a perspective view of a sewing machine cabinet with the flap thereof open and showing in dotted lines a flap support according to the present invention.
Figure 2:
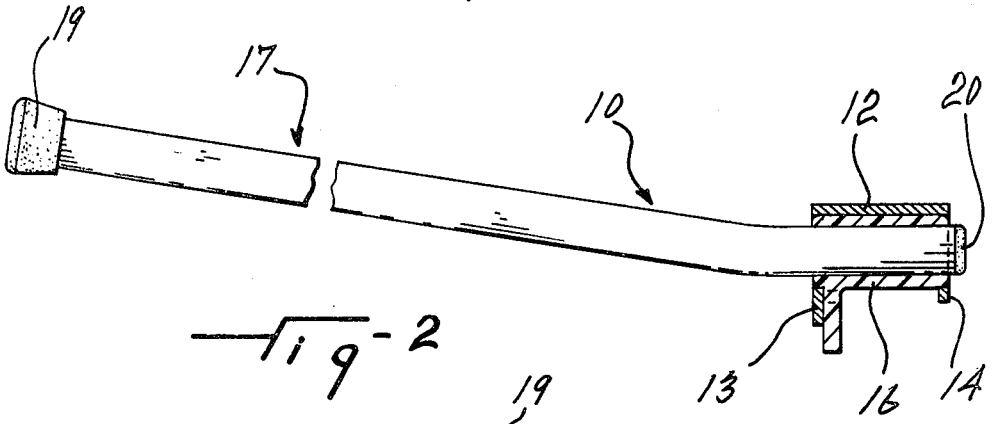
FIG. 2 is a cross-sectional side view of the flap support.
Figure 3:
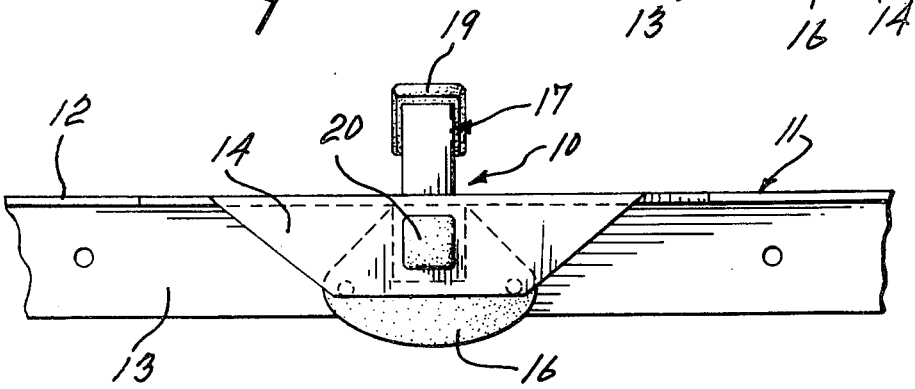
FIG. 3 is an end view of the flap support as seen from the inner end or from the right in FIG. 2.

The illustrated flap support is combined with a sewing machine cabinet and is particularly adapted for such use. However, the same flap support may be used as well with any other piece of furniture having at least one flap which opens to a flat or horizontal position.

The sewing machine cabinet 1 includes a top 2 formed with a generally rectangular and central aperture 3 and forming a relatively narrow portion 4 longitudinally extending between the edge at one end of the top and the edge at the corresponding end of the central aperture 3. The sewing machine itself 5 is conventionally mounted on a board or drop panel 6 which is pivoted by a piano type hinge 7 to pivot the sewing machine between an operative position, shown in FIG. 1, and an inoperative position shown in FIGS. 4 and 5. The sewing machine cabinet 1 also includes the conventional flap 8 which is pivoted along one edge to the outer edge of the narrow top portion 4 by another piano hinge 9.

Figure 4:
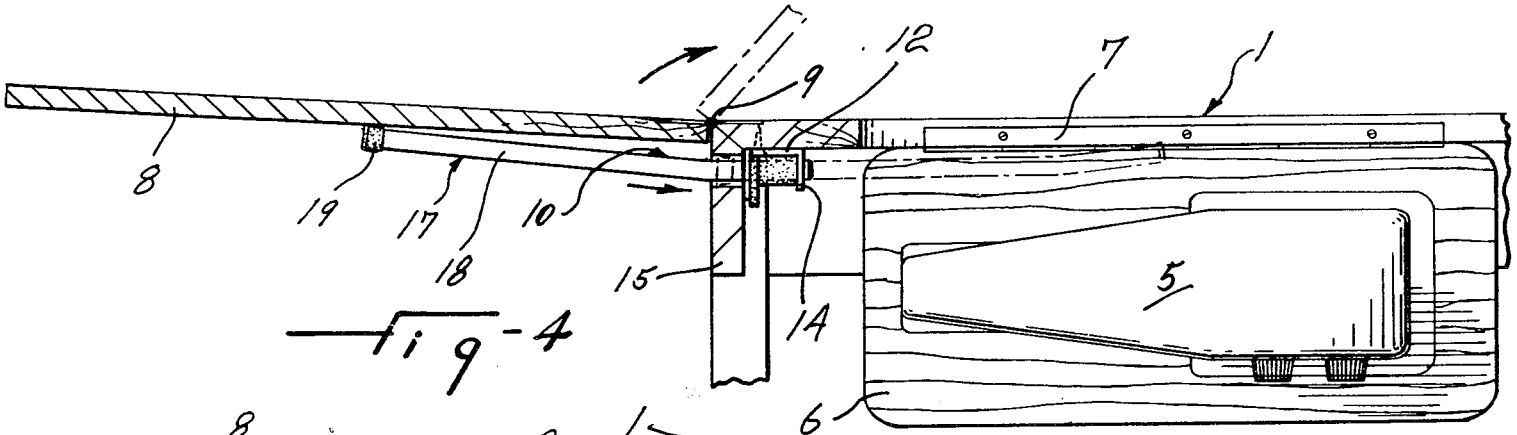
FIG. 4 is a cross-sectional view longitudinally across the sewing machine cabinet of FIG. 1.
Figure 5:
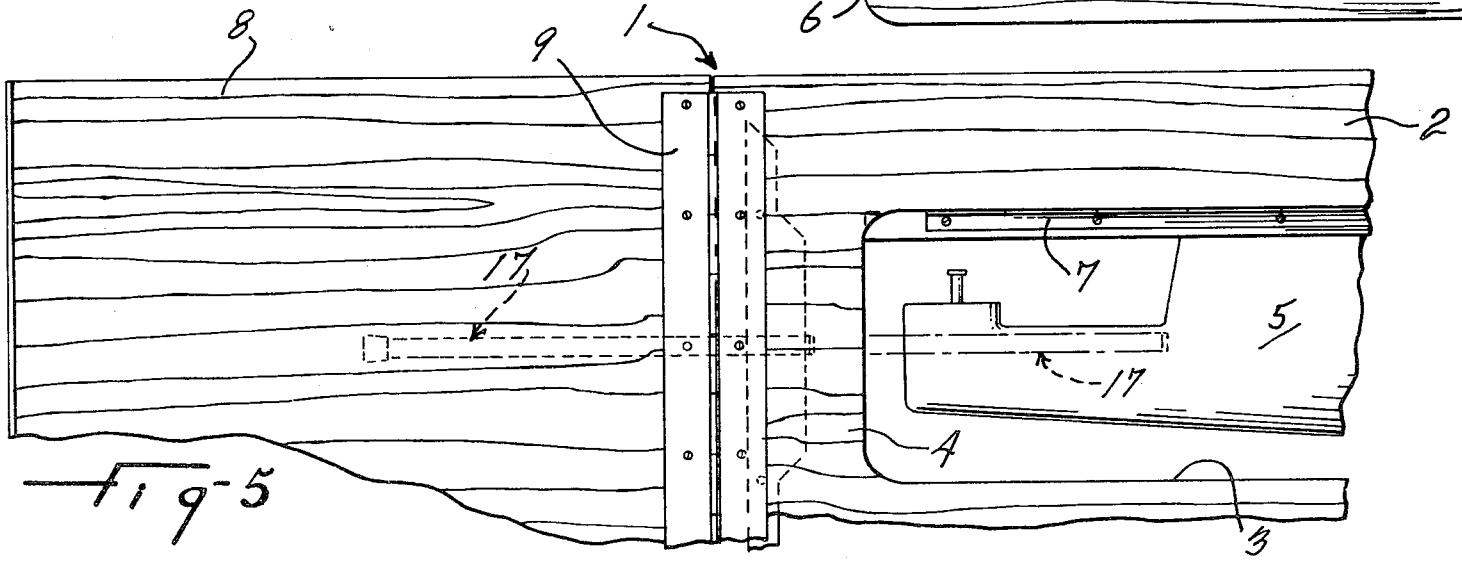
FIG. 5 is a detailed plan of a portion of the sewing machine cabinet, with as in FIG. 4 the sewing machine in lowered position inside the cabinet.

The present invention more particularly includes a flap support 10 which is fixed to the body of the piece of furniture to support the flap 8 in flat open position shown in FIGS. 1, 4 and 5. In this open position, the flap 8 projects edgewise from the corresponding edge of the top 2.

The flap support 10 includes an elongated reinforcing metal bracket 11 which extends lengthwise longitudinally of the narrow top portion 4. The reinforcing bracket 11 includes an upper portion 12 and a pair of side portions 13 and 14 which cooperatively define a C shape cross-section. The upper portion 12 is secured flat against the lower face of the narrow top portion 4 while the side portion 13 is secured against the inner face of the side wall 15 of the cabinet 1. Thus, the bracket 10 reinforces the narrow top portion 4.

A body 16 of sliding resistance material such as rubber or plastic is fixed between the two side portions 12 and 13 of the bracket 11 and extends into apertures in these side portions. These apertures are aligned transversely of the bracket and register with a corresponding aperture in the side wall 15.

The flap support 10 further includes a supporting arm 17 which is tubular and of square cross-section. This supporting arm slidably extends through the sliding resistant body 16 and projects endwise outwardly of the cabinet 1. The arm 17 is bent such that the outer end thereof raises to engage against the lower side of the flap 8. The arm 17 includes the tubular bar 18 and end caps 19 and 20 fixed to the opposite ends respectively of the open ended bar 18. The end caps 19 and 20 are provided to avoid scratching of the flap 8.

When the supporting arm 17 is withdrawn inside the cabinet, the end cap 19 is recessed in the aperture through the side wall 15 and the bar 18 extends above the sewing machine 5 and holds the latter against undue pivoting movement inside the cabinet.

What I claim is:

1. In a piece of furniture or the like, the combination comprising a furniture body including a top panel member and a side wall having an aperture therethrough underneath and adjacent said top panel member, a flap having one edge pivoted to said top panel member to an open flat position outwardly extending edgewise from said top panel member and from said side wall, a flap supporting assembly consisting of a reinforcing bracket member secured against the bottom of said top panel member, said reinforcing bracket constituting an elongated member longitudinally extending lengthwise of said side wall and having a C-shaped transverse profile including a top portion secured against the bottom of said top panel member, a first side portion secured against the inner side of said side wall, and spaced from a second inwardly located side portion, a slideway member fixedly secured between said first and said second side portions, and defining a slideway passage which is non circular and which extends substantially parallel to said top panel member adjacent the bottom face of the latter and in register with said side wall aperture, and a supporting arm of non circular cross-section slidable endwise through said slideway member and said first and second side portions, said reinforcing bracket and said slideway member being located centrally of said side wall and said supporting arm is perpendicular to said side wall and includes an outer longer straight portion and an inner shorter straight portion bent at an obtuse angle relative to each other, whereby said longer straight portion is upwardly inclined when said arm is in extended position and said shorter straight portion engages said slideway passage, and said longer straight ortion engages said slideway passage and is substantially parallel to said top panel member when said arm is in retracted position, said shorter straight portion being then upwardly inclined.

* * * * *